US005512881A

United States Patent [19]

Majmudar

[11] Patent Number: 5,512,881

[45] Date of Patent: Apr. 30, 1996

[54] PERSONAL ALARM APPARATUS

[75] Inventor: Kashyap Majmudar, Willowdale, Canada

[73] Assignees: Alertcall, Inc., Tonawanda; MKM Electronics, Inc., Buffalo, both of N.Y.

[21] Appl. No.: 113,650

[22] Filed: Aug. 27, 1993

[51] Int. Cl.[6] ..... G08B 13/00

[52] U.S. Cl. ..... 340/574; 340/384.4; 340/326; 340/546

[58] Field of Search ..... 340/574, 573, 340/546, 384.4, 384.6, 326, 331, 691, 521, 571, 311.1, 825.44, 825.49; 379/38, 40; 367/197–199; 381/56; 375/309–310

[56] References Cited

U.S. PATENT DOCUMENTS

| | | | |
|---|---|---|---|
| 3,914,692 | 10/1975 | Seaborn, Jr. | 325/53 |
| 4,473,821 | 9/1984 | Yang et al. | 340/539 |
| 4,587,516 | 5/1986 | Hiraki | 340/539 |
| 4,632,232 | 12/1986 | Nelson et al. | 340/546 X |
| 4,737,758 | 4/1988 | Meiksin et al. | 340/51 |
| 4,996,517 | 2/1991 | Kringen et al. | 340/506 |
| 5,115,224 | 5/1992 | Kostusiak et al. | 340/574 |
| 5,196,825 | 3/1993 | Young | 340/539 |
| 5,196,829 | 3/1993 | Janis | 340/574 |
| 5,258,746 | 11/1993 | Leitten et al. | 340/574 |

*Primary Examiner*—Thomas Mullen

*Attorney, Agent, or Firm*—Hodgson, Russ, Andrews, Woods & Goodyear

[57] ABSTRACT

Alarm apparatus which generates a repetitive sound wave having at least two pulses of predetermined frequencies within a predetermined interval of time. A resonator generates the clock frequency therefor. The resonator may have a low tolerance of less than about 0.1 percent so that at least two pulses may be detected by a receiver having a similarly low tolerance so that false triggering of the receiver by other transmitters or background noise may be prevented. A plug is inserted into the alarm housing to maintain circuitry for initiating operation thereof open. Pulling of the plug from the housing allows the circuitry to close to initiate operation of the alarm. A push button is provided on the end of the plug to close the circuitry for initiating operation of the alarm while the plug is inserted into the apparatus. Once the alarm has been initiated, the circuitry is such that the alarm cannot be inactivated except by removal of the internal power source.

20 Claims, 4 Drawing Sheets

PERSONAL ALARM APPARATUS

BACKGROUND OF THE INVENTION

The present invention relates generally to alarm apparatus. More particularly, the present invention relates to apparatus which a person may carry on his or her person for effecting an alarm in case of personal attack or other danger.

The transmission of sound rather than radio frequency signals to a receiver device, as disclosed in U.S. Pat. No. 4,473,821 to Yang et al, the disclosure of which is incorporated herein by reference, has the added advantage of producing of loud noise to attract the attention of people in the vicinity as well as summoning aid by means of the receiver device. A sound wave transmitter also advantageously does not require compliance with various FCC licensing and procedural requirements.

The personal acoustic alarm system of Yang et al includes a miniature portable transmitter which, when activated by a user, produces an audible alarm signal in the audio range for a fixed duration or until the power supply is exhausted to alert persons in the area of the signal transmitter. This audio alarm signal is formed by a plurality of simultaneously generated individual audio frequency sonic signals each of which is supposed to have a different audio frequency. Each of the signals is generated by an oscillator. Receiver units mounted in fixed locations are tuned to receive the audio frequency sonic signals from a specific transmitter or group of transmitters. The receiver unit acts, through a central control unit, to provide some alarm action such as sounding a siren, turning on a strobe light, or dialing a telephone number.

Other patents illustrating the state of the art of personal alarms include U.S. Pat. No. 5,196,825 to Young, U.S. Pat. No. 5,115,224 to Kostusiak et al, U.S. Pat. No. 4,996,517 to Kringen et al, U.S. Pat. No. 4,737,758 to Meiksin et al, U.S. Pat. No. 4,587,516 to Hiraki, and U.S. Pat. No. 3,914,692 to Seaborn, Jr.

The transmitter oscillators for producing such sound waves have conventionally been RC circuits. Commercially available RC circuits at best typically have tolerances of 1 percent on the resistor and 5 percent on the capacitor to provide an overall tolerance between 1 percent and 5 percent. Such a tolerance range requires a broadband receiver. Since the tolerances for each individual frequency may vary and therefore overlap with similar frequency transmissions of other transmitters in the "real world" and since such tolerances are broad enough to encompass various background noises again found in the "real world", the use of a broadband receiver may inadequately distinguish between inputted frequencies from the corresponding transmitter and inputted frequencies generated by one or more other sources.

When faced with personal attack, it is considered desirable not only to attract the attention of other people in the vicinity but also to produce a sound which is irritating to the ears so that an attacker has an incentive for leaving. A sound produced merely by a plurality of frequencies, as in the Yang et al apparatus, may be too regular and therefore too monotonous to have the desired irritating effect.

SUMMARY OF THE INVENTION

It is accordingly an object of the present invention to provide a personal alarm system which generates and transmits a more precise low-tolerance audible signal so that the receiver is not activated except upon receipt of a signal from the personal alarm transmitter.

It is a further object of the present invention to provide such an audible signal which is irritating to the ears.

It is a still further object of the present invention to provide such a personal alarm transmitter that, once activated, cannot be deactivated except upon removal of the power source.

It is yet another object of the present invention to provide such a personal alarm transmitter which can be activated personally or set up for activation by movement of a door or the like thereagainst yet cannot be activated accidentally by the user and, once activated, cannot be deactivated except by removal of the power source.

It is still another object of the present invention to provide such a personal alarm system which is rugged, reliable, effective, and inexpensive.

In order to provide a low-tolerance sound wave transmission in a personal alarm system, in accordance with the present invention, a resonator, instead of a conventional RC circuit, is provided for generating a predetermined clock frequency, and the sound wave pattern is provided to have at least two pulses of predetermined frequencies within a predetermined interval of time.

The personal alarm may also have a rip cord or other means for pulling a plug therefrom, effecting voltage input to a first controller port after which the controller will effect continuous sound transmission as long as voltage is supplied to a second port, the power source being connected for continuous voltage supply to the second port, i.e., without switches or the like for interrupting the power supply. For placing of the alarm next to a door or the like for activation by movement thereof, in accordance with the present invention, a switch such as a push button is provided on the plug and operable by movement of the door thereagainst for alternatively effecting momentary voltage input to the first port whereby removal of the plug is not required to activate the alarm. Preferably, means are provided for preventing accidental activation which could result from inadvertent pressing of the button by the user while the personal alarm is being carried around.

The above and other objects, features and advantages of the present invention will be apparent in the following detailed description of the preferred embodiments thereof when read in conjunction with the accompanying drawings wherein the same reference numerals denote the same or similar parts throughout the several views.

DETAILED DESCRIPTION OF THE PREFERRED EMBODIMENTS

Figure 1:
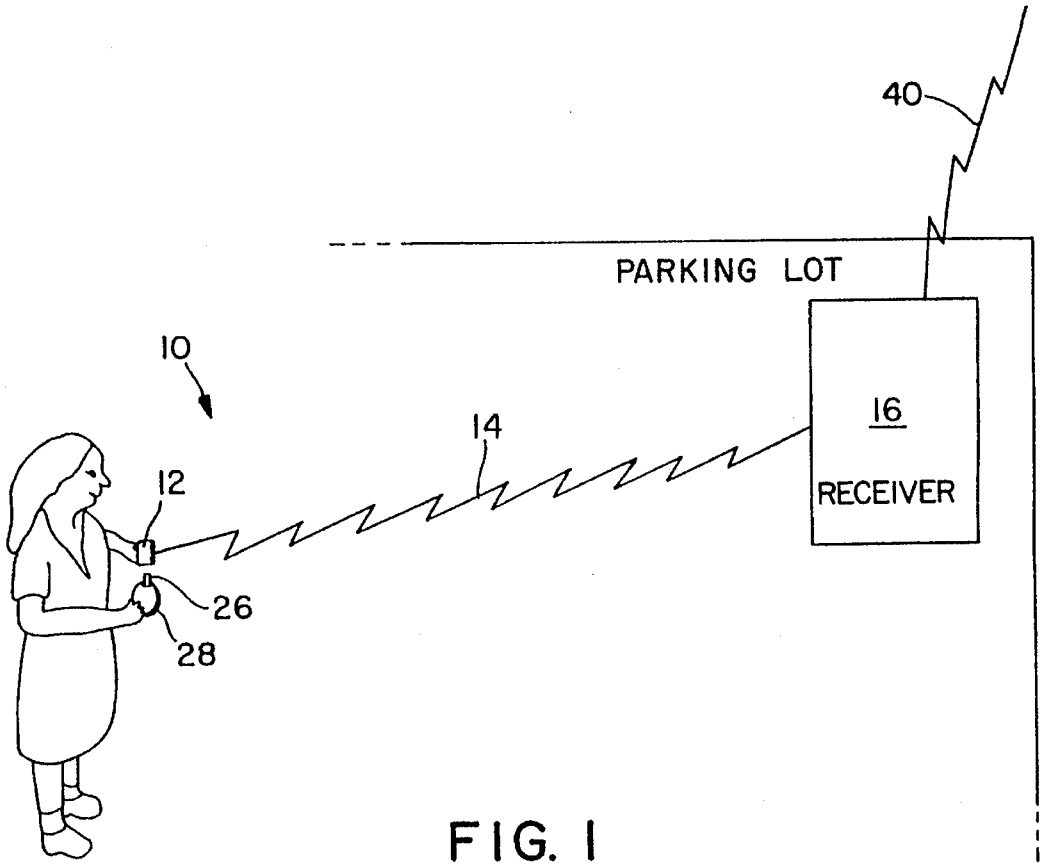
FIG. 1 is a diagrammatic view illustrating the use of a personal alarm system which embodies the present invention.
Figure 2:
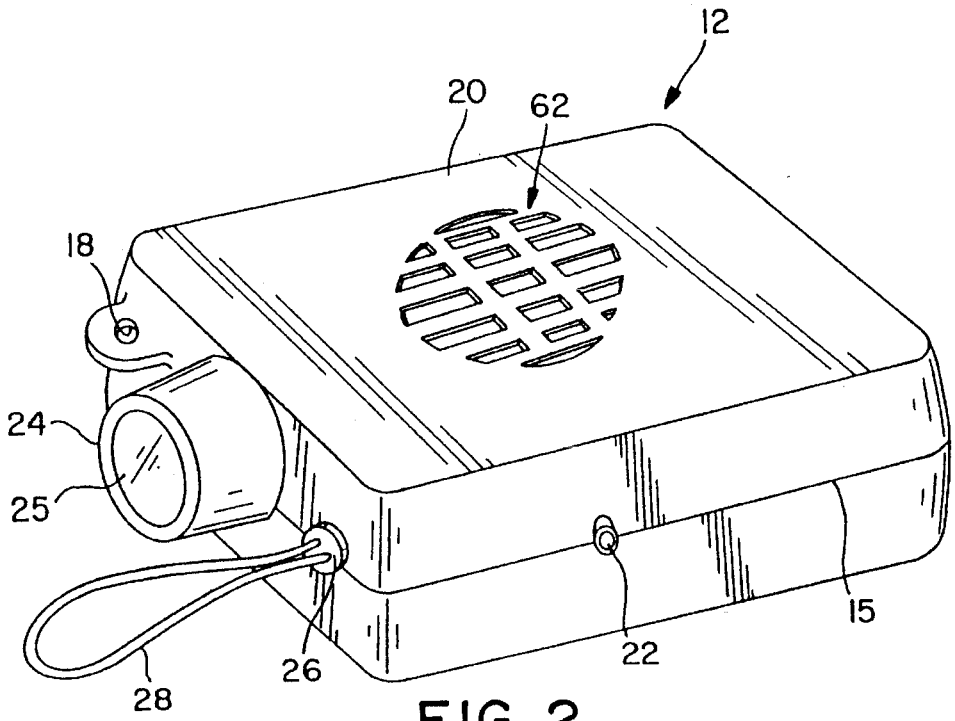
FIG. 2 is a perspective view of a transmitter for the personal alarm system.

Referring to FIGS. 1 and 2, there is illustrated generally at 10 personal alarm apparatus including a transmitter 12 of a sound or audible wave 14 and a receiver 16 therefor.

The transmitter 12 is preferably miniature, i.e., small enough to be carried in one's purse or in one's hand, and it may have an appendage with a hole 18 for a key chain. A test button is illustrated at 22 and an optional strobe light at 24. The dimensions of the transmitter casing 20 may, for example, be 3½ inch by 2¼ inch by 1¼ inch. The strobe light 24 may protrude perhaps about 1¼ inch from a side having a dimension of 3½ inches. The casing or housing 20 comprises two halves connected at seam 15 by perhaps 4 screws (not shown) inserted from the bottom half. The screws may be covered with a label and a pouch (not shown) provided in which the alarm unit 12 may be carried. The casing 20 may be composed of an opaque polycarbonate or ABS material or other suitable material.

A plug 26, illustrated in greater detail in FIGS. 6 to 9, is inserted into the casing 20 to maintain the transmitter inactivated. By pulling the plug 26 out of the casing 20 by suitable means such as the rip cord 28, the transmitter is activated for transmission of sound wave pattern 14, as described in greater detail hereinafter. By "sound wave", as used herein and in the claims, is meant a wave having frequencies within the normal range of hearing of the human ear. However, not all frequencies within the wave need be within this audible range. In order to prevent a culprit from inactivating the alarm, the transmitter 12 cannot be inactivated by re-inserting the plug 26 but requires instead the removal of or loss of power from the power source, i.e., the battery 30 which is within the casing 20.

Figure 4:
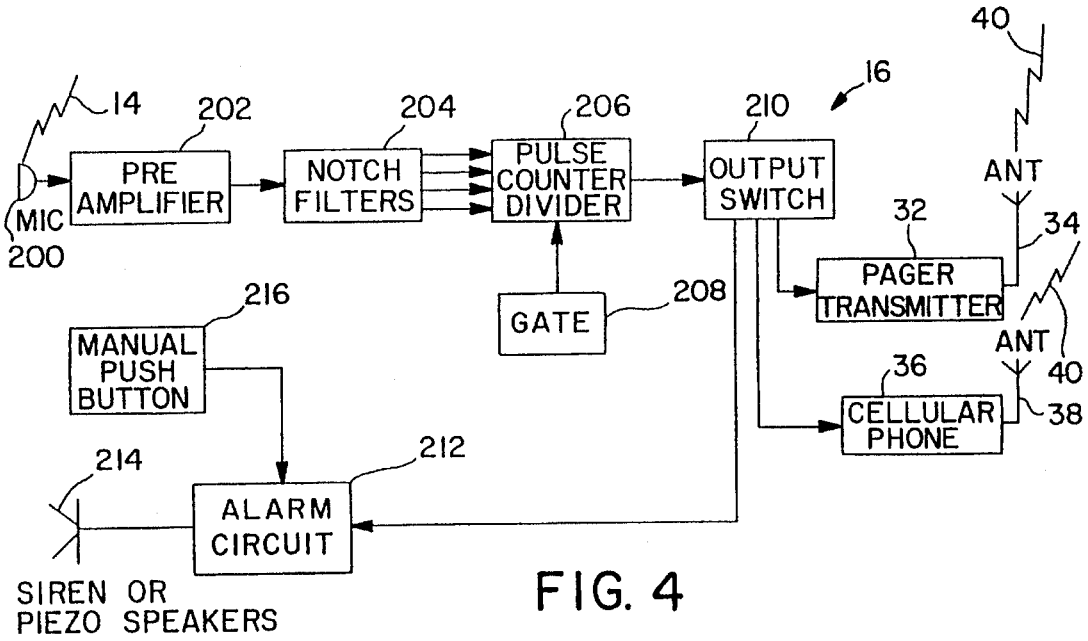
FIG. 4 is a block diagram for a receiver for the personal alarm system.

The receiver 16, which may be one of many permanently installed in parking lots, garages, parks, factories, and the like where the alarm system may be needed, is tuned to receive the sound wave 14 and automatically page or call for help as illustrated by signal 40, by means such as for example, a pager transmitter 32, including antenna 34, and cellular phone 36, including antenna 38 (FIG. 4), or effect other suitable action. In addition or alternatively, the receiver 16 may also sound as an alarm by means of alarm circuit 212 (FIG. 4).

Figure 3:
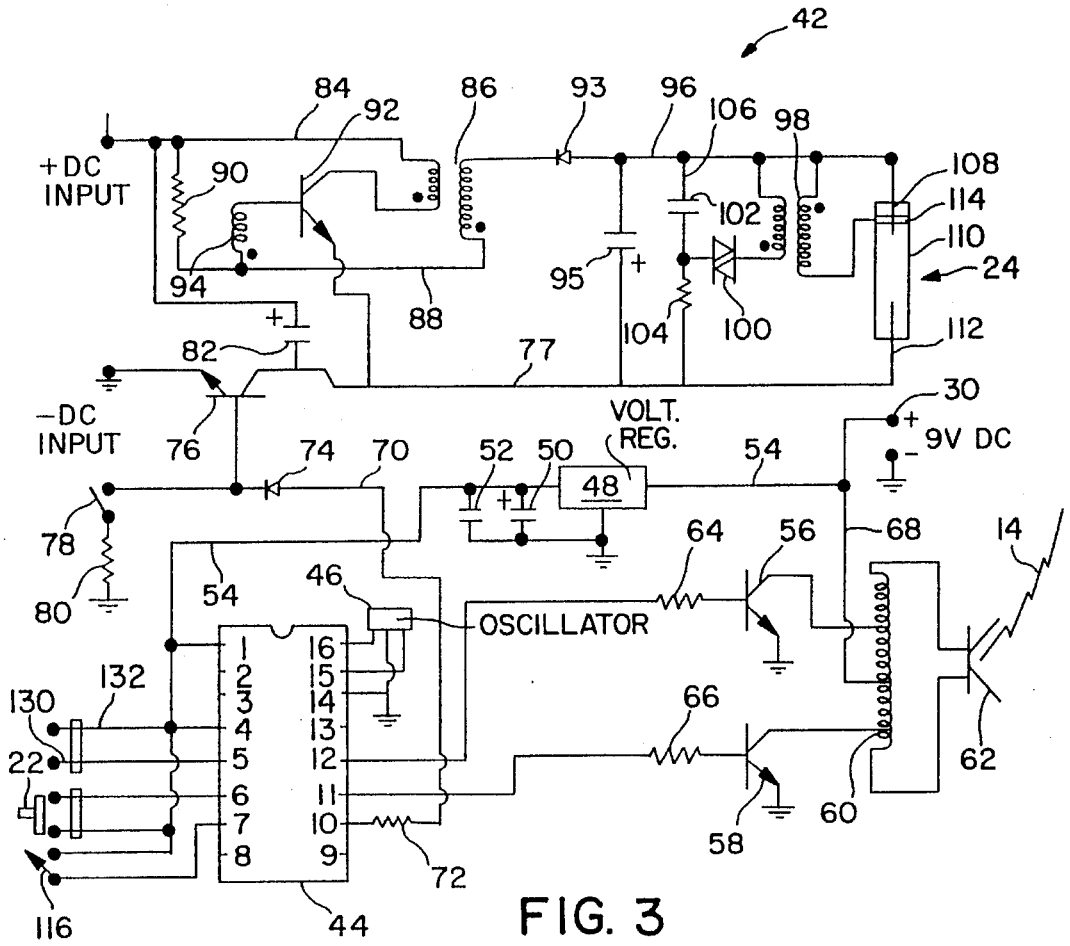
FIG. 3 is a schematic view of a circuit for the transmitter.
Figure 5:
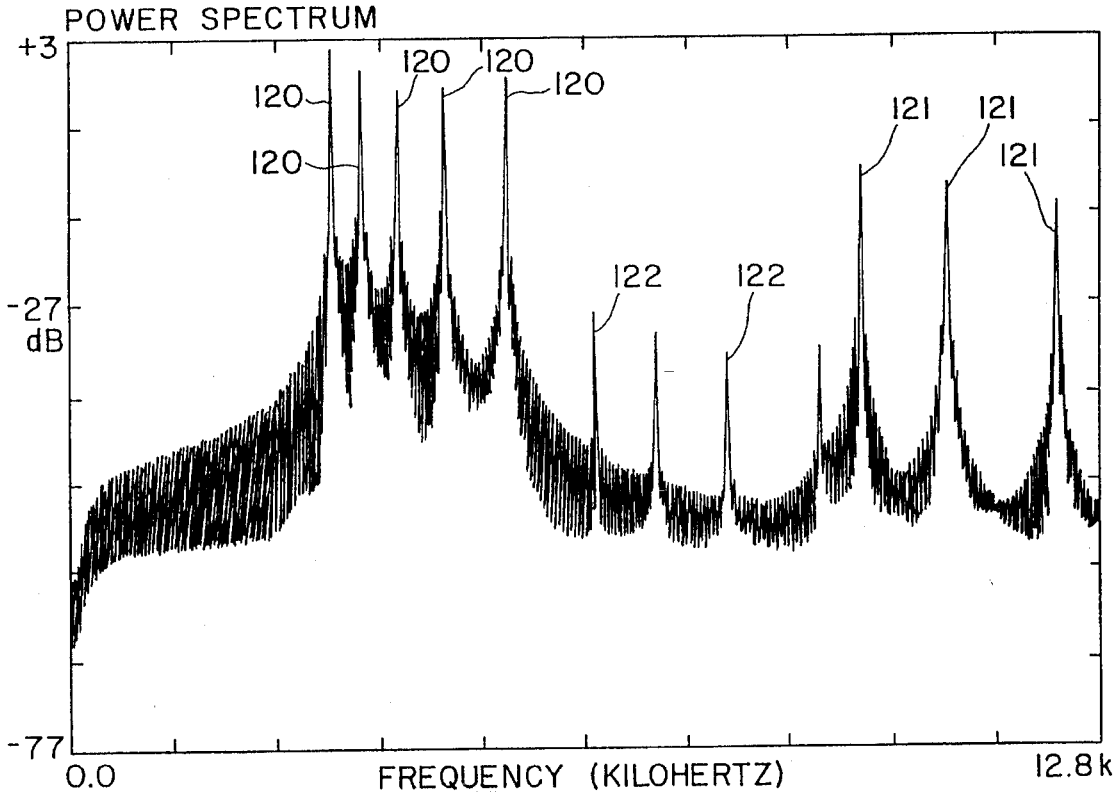
FIG. 5 is a graph of the power spectrum for an illustrative sound wave for which the transmitter controller may be programmed.
Figure 6:
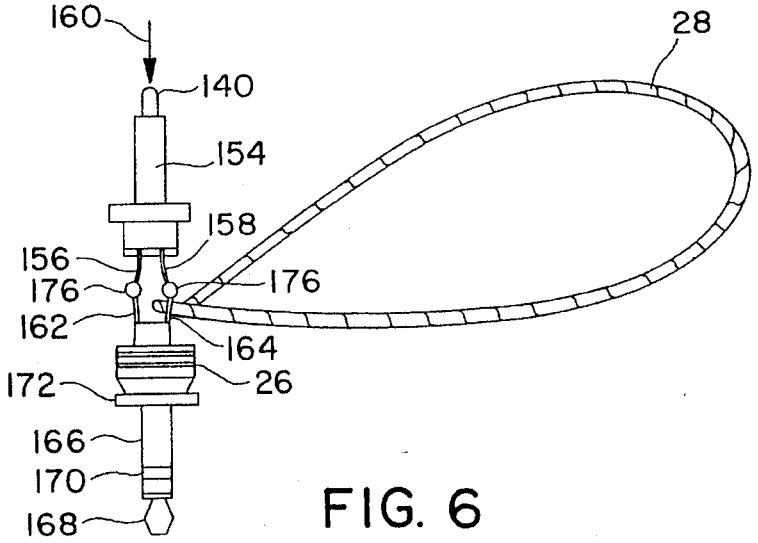
FIG. 6 is side view of a partially assembled plug used for activating the transmitter.

Referring to FIG. 3, there is shown generally at 42 the electrical circuit for the transmitter 12. The circuit includes a suitable digital micro-controller 44 which is suitably programmed to generate the predetermined sound wave pattern 14, which may have a power spectrum such as shown in FIG. 5. An example of a suitable controller means which may be used for this purpose is Motorola micro-controller 68HCO5K1, which is shown to have 16 input/output ports or pins. A program for producing the sound wave pattern 14 having a power spectrum as shown in FIG. 5 is contained in an appendix to this specification.

A clock frequency input to the micro-controller 44 via port 16 is provided by oscillator 46, which will be described in greater detail hereinafter.

The battery 30, which may be 9 volt, supplies electrical power via line 54 and a suitable voltage regulator 48 to the micro-controller 44, the voltage regulator 48 reducing the voltage to a suitable level of perhaps 5 volts for the micro-controller 44. A pair of parallel noise filtering capacitors 50 and 52 are provided with the voltage regulator 48, which may be of the type 78L05 manufactured by Motorola, Inc. of Schaumburg, Ill. Power for controller operation is applied through pins 1 and 14.

The sound wave output from the micro-controller 44 at ports 11 and 12 is via amplifying transistors 56 and 58, operated push-pull, to transformer 60 and a suitable piezo-speaker 62. The bases for transistors 56 and 58 are connected to the ports 12 and 11 respectively via suitable resistors 64 and 66 respectively, each resistor being perhaps about 100 ohm. The transistors 56 and 58 may perhaps be type 2N4401. Power for the speaker 62 may be provided by the battery 30 via line 68 without passage through a voltage regulator so that maximum battery output may be provided for sound generation. Transformer 60 is a step-up transformer which is selected to match the impedance of the piezo-speaker 62. The intensity of the generated sound is desirably in the 125 to 130 decibel range.

Micro-controller port 10 is provided for operation of the strobe light 24 via line 70 and resistor 72 and diode 74 in series with the base of switching transistor 76. Also connected to the base of transistor 76, in parallel therewith, is a switch 78 which is connected to battery 30 via resistor 80. The switch 78 may be opened or closed perhaps by turning the strobe light lens 90 degrees, closing the switch 78 causing the strobe 24 to operate independently of the alarm. Resistors 72 and 80 may perhaps be 200 ohm and 560 ohm respectively. Diode 74 may be type 1N4148, and transistor 76 may be type 2N4401.

The emitter of transistor 76 is connected to negative DC input, and the collector thereof, which is connected to a common point or floating ground 77, is connected via filter capacitor 82 to positive DC input line 84. Line 84 is connected to the secondary of step-up transformer 86 via line 88 and resistor 90, which may perhaps be 560 ohms. One side of the primary of transformer 86 is connected to line 84, and the other side is connected to the collector of transistor 92, which acts as a fly-back inverter having its base connected via feed-back inductor 94 to line 88. A diode 93, which may be type 1N4937, is placed in line 96 in series with the secondary of transformer 86, and charging capacitor 95 is placed in parallel. Thus, inductor 94 continues to feed back in one direction until the transformer 86 voltage saturates, the voltage build-up in that direction ceases and collapses, then the voltage builds up in the opposite direction with a result that a voltage of perhaps about 350 volts may be built-up on the secondary of transformer 86.

The line 96 carrying the voltage of perhaps about 350 volts from the secondary of transformer 86 is connected to a cathode 108 of a gas discharge lamp or ionization chamber 110, which is a conventional flash tube commonly used in photographic cameras, for the strobe light 24. The anode 112 of the chamber 110 is connected to the floating ground 77.

A circuit portion 106 branching from line 96 and in parallel with capacitor 95 comprises step-up transformer 98 with bi-directional diode 100 and charging capacitor 102 in series therewith. A resistor 104, one end of which is connected to floating ground 77, is connected to the circuit portion 106 between the capacitor 102 and the diode 100. The values of capacitor 102 and resistor 104 are chosen so that it takes a predetermined time such as perhaps about 1 second to charge the capacitor 102 to a predetermined breakover voltage of perhaps about 90 volts. For example, the capacitor and resistor values may perhaps be 0.22 mf and 8.2 megohms respectively. The bi-directional diode 100, which may be part No. K1050E made by Teccor Electronics, Inc. of Irving, Tex., does not conduct either way until this breakover voltage is exceeded.

The secondary of transformer 98 is connected between line 96 and a metallic ring 114 which surrounds the cathode 108. The chamber 110 is filled with an ionizing gas such as perhaps xenon. The trigger transformer 98 has a ratio such as to produce in excess of a predetermined voltage such as 3,000 volts which is in the form of a pulse at each time interval when the bi-directional diode 100 conducts. Thus, its ratio may perhaps be about 33:1. This high voltage pulse is impressed on the metallic ring 114 to ionize the gas, and the voltage in line 96 from the secondary of transformer 86 arcs through the ionized gas between the cathode and anode 108 and 112 respectively to cause a flash of the strobe light 24 at each interval of perhaps 1 sec.

It should be understood that the present invention does not require a strobe light in combination with the alarm and that, if provided, the circuitry for the strobe light may take any suitable form. Suitable circuitry for strobe lights is within the purview of one of ordinary skill in the art to which this invention pertains. It should be understood that the alarm device 12 may suitably contain other auxiliary devices as may be desired.

If the strobe light 24 is optionally not provided, its lens 25, which is received in a groove (not shown) of the casing portion therefor and composed of transparent polycarbonate or other transparent tough plastic, is replaced by a flat disk which may be composed of the same material as that of which the casing 20 is composed.

The controller 44 is programmed so that when switch 116, which may be on a side of the casing 20 opposite to switch 22 and therefore not shown in FIG. 2, is open, the strobe 24 and alarm 62 alternate, perhaps every 7 seconds with the strobe 24 flashing at a rate of perhaps 1 flash per second. If the switch 116 is closed, voltage input from line 54 to controller port 7 causes the alarm only to sound. If switch 78 is closed, the strobe 24 is on independent of the alarm, i.e., power is supplied directly from the battery 30 through resistor 80 to the base of transistor 76 (thus by-passing the controller program) for turning it on. The switch 78 may be set up to be closed by turning the strobe lens 90 degrees or may be provided as a separate switch on the casing or as part of switch 116, i.e., a three-way switch, or as otherwise may be suitable. Use of the strobe light only may be desired, for example, while jogging or hunting when it is only necessary to be seen by others. Pressing of test button 22 closes a circuit to supply power from line 54 to controller port 6, the controller 44 being programmed to operate as long as the test button is pushed to close the circuit and ceases operation when the test button is released. Operation of the plug 26 will be described hereinafter.

Referring to FIG. 4, the sound 14 provided by the speaker 62 is picked up by a suitable microphone 200 of the receiver 16. After the sound level is suitably increased in a suitable preamplifier 202, it is passed to two or more notch or band-pass filters 204 each of which passes only a specific frequency pulse. For example, there may be four notch filters 204, as illustrated by the four arrows emanating therefrom in FIG. 4. The frequencies for filters 204 are selected to match frequencies generated by the transmitter 12 to a tolerance of about 0.1 percent or better for precise frequency pulse detection, for reasons which will be more apparent later. In order to achieve such a tolerance, each notch filter comprises a pair of tone filters having overlapping bands so that only a frequency pulse within the overlapping range, which is selected to be within about a 0.1 percent tolerance, is detected. Such a tone filter may be Signetics part No. NE567. These pulses at about a 0.1 percent tolerance are passed to a pulse counter divider stage 206.

With only normal background noise being picked up by the microphone 200, the filters 204 would not pass many of the preselected pulses very often. But when the transmitter 12 is generating sound 14 and it is picked up by the microphone 200, the notch filters 204 will each pass through its specific frequency pulse which is in the sound 14 to the pulse counter divider stage 206. The pulse counter divider stage 206 is gated on and off by a suitable gate stage 208. The gate 208 is timed to stay on for a specified interval of time to determine that each of the designated pulse frequencies is received and perhaps that one or more of them is received a predetermined number of times. The gate 208, whose time interval may be set, for example, to be equal to two cycles of the generated sound 14 may, for example, be Signetics part No. NE555.

If the pulses are detected, as required, within the specified time interval, the pulse counter divider 206 provides a signal to a suitable output switch 210 which may close a circuit to power the alarm circuit 212, which may be the same as the alarm circuit in the transmitter 12 and providing a sound output through siren or piezo-speakers 214. A manual push button 216 may be provided for manual activation of alarm circuit 212. In addition or alternatively to powering the alarm circuit 212, the switch 210 may also turn on the pager transmitter 32 or cellular phone 36 or other suitable equipment. The receiver circuitry may be powered by, for example, a 12 volt DC battery, 120 volt AC, or it may have a replaceable rechargeable battery. Such a receiver system 16 may, for example, be installed in a 12 inch×12 inch×4 inch box which may be mounted on a wall or support pillars.

Referring back to FIG. 3, the controller 44 desirably produces stable high frequency oscillations at perhaps 4.0 megahertz. The desired stability cannot be achieved with the commercially available RC circuits having tolerances in excess of 1 percent. A tolerance of about 0.1 percent is desired in order to avoid false triggering of the receiver 16 while maintaining uniformity from unit to unit so that the transmitter may be mass produced inexpensively for use by the public reliably. In order to achieve a tolerance of about 0.1 percent, in accordance with the present invention, oscillator 46 for generating the clock frequency is a resonator. By "resonator", as used in this specification and the claims, is meant a device composed of a ceramic material or other piezo-type of material which, when a voltage is applied, will resonate at a given frequency. Such resonators or surface acoustic wave (SAW) filters are currently used in computers for generating precise frequencies and are to be distinguished from RC circuits. A resonator may desirably provide a clock frequency tolerance in the range of 0.1 percent, i.e., within 0.1 percent of the desired clock frequency, and, when divided by the controller 44, an even better tolerance for the audio frequencies.

The resonator 46 receives voltage input through controller ports 14 and 15 and outputs a clock frequency of perhaps about 4 megahertz to controller port 16 wherein a buffer capacitor (not shown) internally of the controller filters the clock frequency to run the controller timing without the load affecting the clock frequency.

Referring to FIG. 5, there is illustrated the power spectrum for an exemplary wave pattern 14 for desirably producing a distinctive sound which is irritating to the human ear. This sound may be described as a series of square wave pulses of variable pitch with superimposed waves providing a complex wave form. The controller 44 is programmed to modify the clock frequency output of the resonator 46, in accordance with principles commonly known to those of ordinary skill in the art to which this invention pertains, to produce the sound wave pattern 14 on a repetitive basis of perhaps 4 cycles of the wave pattern each second. This requires suitably dividing the clock frequency output of the resonator 46 to the audible range. The power spectrum for the sound wave pattern includes a plurality of fixed pitch distinct individual sound pulses, illustrated at 120 and 121, repeated in each cycle, thus producing a distinctive sound pattern. Except for the pulses 120 and 121, which are in a hearing range of −17 to +3 dB, most of the frequencies in the power spectrum of the wave output are generally outside the normal audible range or only slightly audible. Thus, the four pulses 122 are generally out of the audible range and should be disregarded. The five pulses 120 are programmed into the wave to have low frequencies between about 3.2 and 5.8 kilohertz at a loud level approaching 3 dB. The three pulses 121 are programmed into the wave to have high frequencies between about 9.6 and 12 kilohertz at a loud level in excess of −17 dB. The repetitive rate of relatively high and relatively low frequencies is provided to give the sound a wobulating effect, similar to that of a police siren, with the loud high and low frequency pulses 120 and 121 (a combination of shrill and base sounds in sequences unpredictably displeasing to the ear) thus to provide an annoying or irritating characteristic to the sound. With the use of the low-tolerance resonator, such a distinctive sound pattern may be precisely duplicated for maintaining uniformity during mass production of the transmitter units 12 for widespread use without false triggering of the receivers 16.

For example, by selecting three frequencies from the five frequencies 120 in the range of about 3.264 to 5.8 kilohertz and the last frequency pulse 121 at about 12 kilohertz, a unique combination of frequency pulses may be obtained which is highly unlikely to be in other alarms or in background noise within the time interval for the gate 208. The previously discussed low-tolerance notch filters 204 must therefore pass each of these four frequency pitches respectively during the selected time interval for the gate 208 for the output switch 210 to be activated.

As the number of distinctive frequency pulses to be passed by the notch filters 204 (four in the above example) is increased, the chances of false triggering are reduced. The time interval of the gate 208 is preferably selected to equal the time interval of two cycles of the pattern (perhaps about ½ sec.). However, it should be understood that, in accordance with the present invention, as little as two frequency pulses may be selected for passing the notch filters 204 during the gate time interval for activating the receiver 16. The repetitive rate of the sound pattern also allows the gate 208 to count the number of each of the pulses passing the notch filters 204 during a time interval of perhaps 2 seconds and activating the receiver 16 only if the count for each of the pulses is correct. Once a first of the frequency pulses is passed to start the time interval, if the count during the time interval is not correct, then the gate 208 will not activate the receiver 16 and will be re-set to wait for passage of another of the frequency pulses.

The microphone 200 picks up various sounds including background noises in its surrounding area. In the example, the amplified sounds are passed to the band-pass filters 204 which are selected respectively for the 3.292 kilohertz frequency of the first of the pulses 120 as well as the three other frequencies of the selected pulses. The repetition rate for the sound wave 14 in the example is calculated to be about 328.5 msecs. The repetition rate is very precise since it is derived from the low-tolerance clock frequency. This translates into about 3.044 hertz for the wave 14. When the first frequency pulse is passed or recognized, a gate pulse is started. If the gate is opened for a two-second time interval, there should be a total count of about 6 counts (3.044×2) for a specific frequency pulse. In order to activate the receiver 16, the gate 208 must check that the four distinct frequency pulses have been received and may also be required to check that the total count of one of the pulses in the two-second interval is 6. If both of these conditions are met, the gate 208 will initiate activation of the receiver 16. Again, it should be understood that while the present invention may incorporate various combinations of pulses to be passed and counting thereof, as in the above example, the present invention only requires the detection of two or more frequency pulses within a predetermined time interval.

Referring again to FIG. 3, power through line 54 is continuously available to pin or port 4 of the controller 44. The controller 44 is programmed so that momentary power to port 5 will initiate operation of the transmitter 12 which cannot be stopped unless power is removed from port 4. Insertion of the plug 26 into the casing 20, as shown in FIG. 2, serves to maintain the line or terminal 130 to port 5 disconnected from the line or terminal 132 to power supply line 54 so that power from line 54 is prevented from application to port 5 to thereby prevent activation of the transmitter 12. Pulling of the plug 26 from the casing 20 by means of rip cord 28 or otherwise causes electrical connection between terminals 130 and 132 whereby voltage from battery 30 is supplied through port 5 to activate the program of controller 44 and thereby activate operation of the transmitter. The controller 44 is programmed so that, once activated by power to port 5, it cannot be inactivated and thus the transmitter operation cannot be stopped as long as power is supplied to port 4. Thus, transmitter operation cannot be stopped by disconnecting port 5 from power supply line 54 by re-insertion of the plug 26 into the casing 20.

There are times when it may be desirable to activate the transmitter 12 under conditions wherein it is not feasible to pull the plug 26 from the casing 20. For example, it may be desired to place the transmitter 12 adjacent to a door in such a manner that movement of the door during opening thereof by an intruder will activate the alarm. In order to effect alarm operation by such door movement, in accordance with the present invention, a push button 140 is connected to plug 26 to protrude therefrom. Thus, when the alarm unit 12 is placed next to a door with the push button 140 adjacent the door, movement of the door by an intruder may push or operate the push button 140 to activate the alarm unit 12, as hereinafter discussed. The pushing of the push button 140 need only be momentary since, once the controller 44 is activated by power to port 5, it no longer needs power to port 5 and will continue operating as long as power is supplied to port 4.

Referring to FIGS. 6 to 9, the plug is insertable in a jack 142 having three prongs 1, 2, and 3. Prongs 1 and 3 of the jack are connected to terminals 132 and 130 for power supply line 54 and controller port 5 respectively. Terminals 2 and 3 are connected by line 144. Connection between jack terminals 1 and 2 may be made by connection (which can be disconnected) of line 146 to jack portion 148, which is suitably insulated from jack portion 150, jack portion 148 being connected to terminal 1 and jack portion 150 being connected to jack terminal 3 as well as jack terminal 2. When jack terminals 1 and 2 are connected, power through line 54 is supplied therethrough to controller port 5. Disconnection of jack terminal 1 from jack terminal 2, as illustrated schematically at 152, opens the circuit so that power through line 54 is not supplied to controller port 5.

Figure 9:
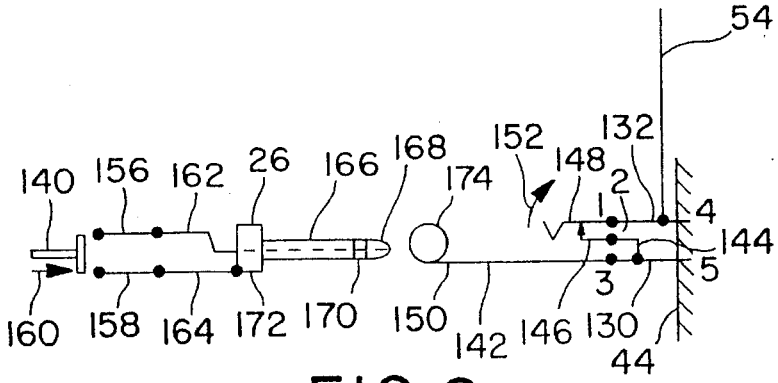
FIG. 9 is a schematic view illustrating the connection between the plug and the transmitter circuit.

The push button housing 154 contains two lines 156 and 158 which are insulated from each other and which are connectable by the push button 140, as illustrated at 160 in FIG. 9. Push button lines 156 and 158 are soldered or otherwise suitably connected to lines 162 and 164 respectively of plug 26.

The plug 26 has a hollow barrel portion 166 and a tip portion 168 which is insulated therefrom by a ring 170 of insulating material or by other suitable means. Line 164 is soldered or otherwise suitably attached to barrel portion 166, which includes a ledge portion 172 for engaging the jack opening 174 for precisely positioning the plug relative to the jack for making suitable electrical connection and disconnection as needed. Line 162 extends through hollow interior of barrel portion 166 and is soldered or otherwise suitably attached to the plug tip 168. Thus, push button lines 156 and 158 are electrically connected to the insulated tip 168 and barrel portion 166 respectively.

When the plug 26 is inserted into the jack 142, the tip 168 contacts the jack portion 148 and thus makes electrical connection between push button line 156 and power supply line 54. The tip 168 also breaks contact between jack pins 1 and 2 and thus disconnects the electrical connection between line 132 (which is electrically connected to the battery 30 via line 54) and line 130 for controller port 5 so that electrical power is not supplied to controller port 5. The barrel portion 166 contacts the jack portion 150 and thus makes electrical connection between push button line 158 and controller port 5. By pressing momentarily the push button 140, as illustrated at 160, to engage the terminals of lines 156 and 158, electrical connection is made for supplying electrical energy from battery 30 through line 54 and through lines 156 and 158 to controller port 5 for initiating operation of the controller 44 and thus the alarm unit 12. As previously discussed, subsequent release of the push button 140 and the consequent removal of power from controller port 5 will not inactivate the alarm unit 12.

In construction of the plug/push button assembly, the rip cord loop 28, which may be composed of nylon or other suitable material and which may be perhaps about 9 inches in length, is passed between the lines 156, 162 and 158, 164 thereof before they are soldered together, as illustrated at 176, or otherwise suitably connected. The assembly is then molded in soft plastic or other suitable material to provide a housing 178 with the rip cord 28 extending through the housing wall on opposite sides thereof.

Figure 7:
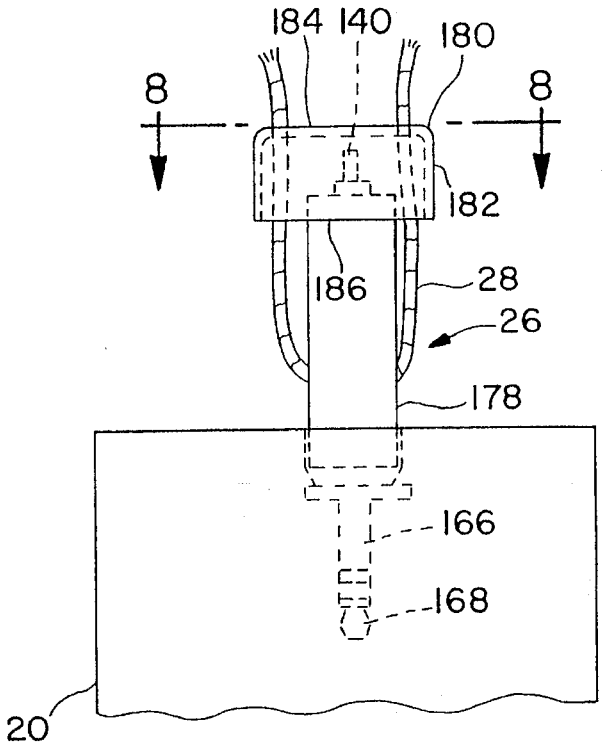
FIG. 7 is a side view of the plug, fully assembled, and illustrated inserted into the transmitter housing.
Figure 8:
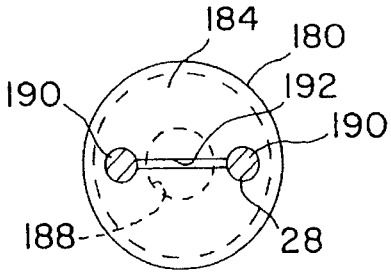
FIG. 8 is a view taken along lines 8—8 of FIG. 7.

In order to prevent the push button 140 from being depressed and accidentally activating the alarm while carrying the alarm around, in accordance with the present invention, a protective cap 180 is provided to protectively cover the push button 140 so that it may not be accidentally pushed during normal use. The cap 180, which is composed of a soft plastic such as vinyl or other suitable material, has a cylindrical wall 182 extending between upper and lower walls 184 and 186 respectively, thus providing a hollow interior. Lower wall 186 has an aperture 188 sized so that the cap 180 can be press fit over housing 178, as illustrated in FIG. 7, so that the upper wall 184 is protectively spaced from the push button 140.

In order that the cap 180, when removed from the housing 178, may be retained with the alarm unit 12 so that it is not lost, the upper wall 184 has a pair of spaced apertures, illustrated at 190, for passage of the rip cord 28. Thus, when removed from the housing 178, the cap 180 remains attached to the rip cord 28. A narrow slot 192 extends between and opens into the apertures 190 to permit insertion of the rip cord 28 into the apertures or disengagement therefrom.

It should be understood that, while the invention has been described in detail herein, the invention can be embodied otherwise without departing from the principles thereof, and such other embodiments are intended to come within the scope of the present invention as defined in the appended claims.

APPENDIX

Program for Microcontroller 44

```
S10700E00101010114
S104001706DE
S11302009CA680B700A6F0B7041F0011E31D003FB1
S1130210E1A623B7E08E20F1A603B70A000027A6C3
S113022016B7080200069BA602B708809A01E306E7
S11302301D001F0020ED1D001E00CD02AD1F001C7F
S113024000CD02AD20DD9DA616B7089A01E3061D78
S1130250001F0020F71D001E00CD02AD1F001C0072
S1130260CD02AD20E79D01E112B6E0A119231E3AAB
S1130270E03AE03AE03AE03AE02018B6E0A12D2472
S1130280103CE03CE03CE03CE03CE0200611E12096
S11302900210E19D0400113AE2260D00E30610E38A
S11302A01A00200411E31B00A616B70880BEE05A0A
S10602B026FD81A3
S10B03F8026502180200020074
```

What is claimed is:

1. Alarm apparatus comprising electrical circuit means including controller means for generating a variable frequency repetitive sound wave having at least two different predetermined frequencies which occur within a predetermined interval of time, and a resonator for generating a predetermined clock frequency for the sound wave.

2. Alarm apparatus according to claim 1 wherein said resonator has a tolerance of less than about 0.1 percent.

3. Alarm apparatus according to claim 1 wherein said resonator is a ceramic resonator.

4. Alarm apparatus according to claim 1 further comprising power supply means, said controller means having at least a first port and a second port, means for applying power to said first port to initiate operation of said controller means, and means free of switches for connecting said power supply means to said second port for applying power thereto so that, after initiation of said controller means by application of power to said first port, said controller means continues to operate until the application of power to said second port is ceased.

5. Alarm apparatus according to claim 1 wherein said electrical circuit means further includes an alarm means, the apparatus further comprising strobe light means and means for operating said strobe light means alternately with said alarm means.

6. Alarm apparatus according to claim 5 further comprising means for supplying electrical power to said strobe light means for operation independently of said alarm means.

7. Alarm apparatus comprising electrical circuit means including controller means for generating a variable frequency repetitive sound wave having at least two different predetermined frequencies which occur within a predetermined interval of time, a resonator for generating a predetermined clock frequency for the sound wave, means for receiving the sound wave including means for detecting said at least two predetermined frequencies within said predetermined interval of time, and means responsive to the detecting of said at least two predetermined frequencies within said predetermined interval of time for initiating a predetermined action.

8. Alarm apparatus according to claim 7 wherein each of said resonator and said detecting means has a tolerance of less than about 0.1 percent.

9. Alarm apparatus according to claim 7 wherein said resonator is a ceramic resonator.

10. Alarm apparatus according to claim 7 further comprising power supply means, said controller means having at least a first port and a second port, means for applying power to said first port to initiate operation of said controller means, and means free of switches for connecting said power supply means to said second port for applying power thereto so that, after initiation of said controller means by application of power to said first port, said controller means continues to operate until the application of power to said second port is ceased.

11. Alarm apparatus according to claim 7 where said electrical circuit means further includes an alarm means, the apparatus further comprising strobe light means and means for operating said strobe light means alternately with said alarm means.

12. Alarm apparatus comprising a housing, electrical circuit means including controller means within said housing for generating a sound wave and having means defining a first port and a second port, a power supply means within said housing, first circuit means for applying power to said first port to initiate operation of said controller means, second circuit means for applying power from said power supply means to said second port after operation of said controller means is initiated for continued operation of said controller means, said controller means continuing to operate after operation thereof is initiated as long as power is applied by said second circuit means to said second port, said second circuit means being free of switches between said power supply means and said second port, and plug means adapted to be inserted into said housing for opening said first circuit means whereby pulling said plug means from said housing closes said first circuit means to apply power to said first port for initiating operation of said controller means after which said controller means continues to operate until the application of power to said second port is ceased, the apparatus further comprising switch means connected to said plug means, said plug means comprising a first circuit portion and a second circuit portion insulated from said first circuit portion, means for disconnecting said power supply means from said first port and for connecting said first circuit portion to said power supply means and said second circuit portion to said first port during a period of time when said plug means is inserted into said housing, said switch means including means for connecting said first circuit portion to said second circuit portion for applying power from said power supply means to said first port during a period of time when said plug means is inserted into said housing.

13. Alarm apparatus according to claim 12 wherein said switch means is a push button.

14. Alarm apparatus according to claim 12 wherein said electrical circuit means generates a variable frequency repetitive sound wave having at least two different predetermined frequencies which occur within a predetermined interval of time, the apparatus further comprising a resonator for generating a predetermined clock frequency for the sound wave.

15. Alarm apparatus according to claim 14 wherein said resonator has a tolerance of less than about 0.1 percent.

16. Alarm apparatus according to claim 12 further comprising means for protectively covering said switch means to prevent accidental operation thereof.

17. Alarm apparatus comprising a housing, electrical circuit means including controller means within said housing for generating a sound wave and having means defining a first port and a second port, a power supply means within said housing, first circuit means for applying power to said first port to initiate operation of said controller means, second circuit means for applying power from said power supply means to said second port after operation of said controller means is initiated for continued operation of said controller means, said controller means continuing to operate after operation thereof is initiated as long as power is applied by said second circuit means to said second port, said second circuit means being free of switches between said power supply means and said second port, and plug means adapted to be inserted into said housing for opening said first circuit means whereby pulling said plug means from said housing closes said first circuit means to apply power to said first port for initiating operation of said controller means after which said controller means continues to operate until the application of power to said second port is ceased.

18. Alarm apparatus according to claim 17 wherein said electrical circuit means generates a variable frequency repetitive sound wave having at least two different predetermined frequencies which occur within a predetermined interval of time, the apparatus further comprising a resonator for generating a predetermined clock frequency for the sound wave.

19. Alarm apparatus comprising a housing, electrical circuit means including controller means within said housing for generating a sound wave and having means defining a first port and a second port, a power supply means within said housing, first circuit means for applying power to said first port to initiate operation of said controller means, second circuit means for applying power from said power supply means to said second port after operation of said controller means is initiated for continued operation of said controller means, said controller means continuing to operate after operation thereof is initiated as long as power is applied by said second circuit means to said second port, said second circuit means being free of switches between said power supply means and said second port, and plug means adapted to be inserted into said housing for opening said first circuit means whereby pulling said plug means from said housing closes said first circuit means to apply power to said first port for initiating operation of said controller means after which said controller means continues to operate until the application of power to said second port is ceased, the apparatus further comprising switch means connected to said plug means for closing said first circuit means during a period of time in which said plug means is inserted into said housing.

20. Apparatus according to claim 19 further comprising means for protectively covering said switch means to prevent accidental operation thereof.

* * * * *